US010096438B2

(12) United States Patent
Yamamoto

(10) Patent No.: US 10,096,438 B2
(45) Date of Patent: Oct. 9, 2018

(54) SWITCH DEVICE

(71) Applicant: Masahiro Yamamoto, Aichi (JP)

(72) Inventor: Masahiro Yamamoto, Aichi (JP)

(73) Assignee: OMRON AUTOMOTIVE ELECTRONICS CO., LTD., Aichi (JP)

( * ) Notice: Subject to any disclaimer, the term of this patent is extended or adjusted under 35 U.S.C. 154(b) by 0 days.

(21) Appl. No.: 15/674,298

(22) Filed: Aug. 10, 2017

(65) Prior Publication Data

US 2018/0047528 A1 Feb. 15, 2018

(30) Foreign Application Priority Data

Aug. 10, 2016 (JP) ..... 2016-157578

(51) Int. Cl.

| | |
|---|---|
| ***H01H 13/14*** | (2006.01) |
| ***H01H 13/04*** | (2006.01) |
| ***H01H 13/20*** | (2006.01) |
| ***H01Q 7/00*** | (2006.01) |

(52) U.S. Cl.

CPC ..... *H01H 13/14* (2013.01); *H01H 13/04* (2013.01); *H01H 13/20* (2013.01); *H01Q 7/00* (2013.01); *H01H 2231/026* (2013.01)

(58) Field of Classification Search

CPC .... H01H 19/14; H01H 19/11; H01H 2221/01; H01H 13/023; H01H 2231/026; H01H 2300/032; H01H 27/00; H01H 9/0271; H01H 13/14; H01H 13/04; H01H 13/20

USPC ..... 200/11 R, 564, 336, 11 DA, 11 J, 19.18, 200/314, 340–345

See application file for complete search history.

(56) References Cited

U.S. PATENT DOCUMENTS

| | | | | |
|---|---|---|---|---|
| 7,811,160 | B2 * | 10/2010 | Ogawa | B60H 1/00985 454/121 |
| 8,551,234 | B2 * | 10/2013 | Kim | F24F 3/16 200/11 R |
| 2004/0206610 | A1 | 10/2004 | Hasegawa et al. | |
| 2005/0224322 | A1 * | 10/2005 | Kikuya | H01H 9/181 200/11 R |
| 2010/0101363 | A1 * | 4/2010 | Hisada | G05G 1/105 74/507 |

(Continued)

FOREIGN PATENT DOCUMENTS

| | | | |
|---|---|---|---|
| JP | 2004314806 | A | 11/2004 |
| JP | 2011027085 | A | 2/2011 |

(Continued)

*Primary Examiner* — Ahmed Saeed
(74) *Attorney, Agent, or Firm* — Osha Liang LLP

(57) ABSTRACT

A switch device includes a button, a slider, and a holder in which the button and the slider are slidably held. The slider includes first guide portions. The holder includes: a first holding portion which holds the button; a second holding portion which holds the slider; and second guide portions engaged with the first guide portions. The button includes: a protrusion wall interposed between the second holding portion and the slider; and engaging portions provided in the protrusion wall and engaged with guide projection portions. At least one guide projection portion is provided to extend in a sliding direction of the slider, and a fitting-in portion into which an end portion of the protrusion wall is fitted is provided on a side surface of the guide projection portion extending in the sliding direction.

6 Claims, 11 Drawing Sheets

(56) References Cited

U.S. PATENT DOCUMENTS

2012/0075063 A1 3/2012 Sakamoto et al.

FOREIGN PATENT DOCUMENTS

JP 2011060626 A 3/2011
JP 2011169180 A 9/2011

* cited by examiner

SWITCH DEVICE

CROSS-REFERENCES TO RELATED APPLICATIONS

This application is based upon and claims the benefit of priority from Japanese Patent Application No. 2016-157578, filed on Aug. 10, 2016; the entire contents of which are incorporated herein by reference.

FIELD

One or more embodiments of the present invention relate to a switch device including a button to be pushed in order to drive an engine or the like of a vehicle.

BACKGROUND

There is a switch device including a button to be pushed in order to drive a target object. For example, a switch device as described in JP-A-2004-314806, JP-A-2011-169180, JP-A-2011-60626, and JP-A-2011-27085 is incorporated in a vehicle security system in which a travel driving source (an engine or the like) of a vehicle is started or stopped on the basis of wireless communication between an in-vehicle device and a portable device which is carried by a user so as to prevent the vehicle from being stolen. In the vehicle security system, the traveling driving source is started or stopped when the portable device is successively authenticated through the wireless communication between the in-vehicle device and the portable device and the button of the switch device provided in a vehicle cabin is pushed.

The switch device as in JP-A-2004-314806, JP-A-2011-169180, JP-A-2011-60626, and JP-A-2011-27085 includes a slider, a movable contact point, a substrate provided with a fixed contact point, an elastic member, a coil antenna, and a tube-shaped holder or a case that accommodates those described above in addition to the button. The button and the slider are held in the holder or the case such that the button and the slider can slide in a pushing direction of the button or in a direction opposite to the pushing direction. The slider slides when the button is pushed. The elastic member urges the slider and the movable contact point toward the button.

When the button of the switch device is pushed, the slider slides and the movable contact point comes into contact with the fixed contact point. When the pushed button is released, the slider slides toward the button due to an elastic force from the elastic member so that the button returns to a regular position and the movable contact point is separated from the fixed contact point.

As an auxiliary communication method for a case where the communication cannot be performed with a battery in the portable device having been consumed, an activation electric wave that operates the portable device is transmitted from the coil antenna. When the portable device receives the activation electric wave transmitted from the coil antenna, the portable device communicates with the in-vehicle device by using an electromotive force generated by an internal coil.

In JP-A-2004-314806, the coil antenna is disposed in the vicinity of the button. However, according to this configuration, the size of the switch device in a radial direction of the button becomes large. In JP-A-2011-169180, JP-A-2011-60626, and JP-A-2011-27085, the coil antenna is disposed inside the button so as to achieve reduction in size of the switch device.

SUMMARY

To hold the button and the slider in the tube-shaped holder such that the button and the slider can slide as in the related art, it is necessary to provide a gap between sliding portions of the holder and the button, and to provide a gap between sliding portions of the holder and the slider. Therefore, in a case where the dimensional tolerances for the sliding portions do not match, the gaps become large and the button may be pushed in a state of being inclined with respect to a normal pushing direction of the button with the button wobbling in the holder. Accordingly, there may be a decrease in the operability. Furthermore, there is a possibility that the inclined button or the slider may not move up to a predetermined position so that the movable contact point does not come into contact with the fixed contact point.

In addition, to improve the operability of the button or the slider, it is effective to decrease the area of the sliding portions of the holder, the button, and the slider by devising the shapes of the sliding portions. However, in this case, the strengths of the sliding portions are decreased and the sliding portions become likely to be damaged.

An object of an embodiment of the invention is to provide a switch device with which it is possible to suppress wobbling of a button and to secure the strength of the button or a slider.

A switch device according to an embodiment of the invention includes a button to be pushed, a slider that slides when the button is pushed, a tube-shaped holder in which the button and the slider are slidably held, a case that is attached to a portion of the holder which is opposite to the button, a fixed contact point that is accommodated in the case, a movable contact point that is accommodated in the case and moves so as to come into contact with the fixed contact point when the slider slides, and an elastic member that is accommodated in the case and urges the slider and the movable contact point toward the button. In this configuration, the slider includes a plurality of first guide portions which are provided on an outer circumferential surface of the slider at predetermined intervals in a circumferential direction. The holder includes a first holding portion which holds the button, a second holding portion which is provided closer to a central axis of the holder than the first holding portion and holds the slider, and a plurality of second guide portions which are provided on an inner circumferential surface of the second holding portion at predetermined intervals in the circumferential direction and are engaged with the plurality of first guide portions. One of the first guide portion and the second guide portion is a guide projection portion which protrudes in a radial direction of the slider and the other of the first guide portion and the second guide portion is a guide groove which is recessed in the radial direction of the slider. The button includes a protrusion wall which is interposed between the inner circumferential surface of the second holding portion and the slider and a plurality of engaging portions which are provided in the protrusion wall at predetermined intervals in a circumferential direction of the button and are respectively engaged with a plurality of guide projection portions. In addition, at least one guide projection portion is provided to extend in a sliding direction of the slider and a fitting-in portion into which an end portion of the protrusion wall is fitted is provided on a side surface of the guide projection portion extending in the sliding direction.

According to the above description, the plurality of first guide portions provided on the slider and the plurality of second guide portions provided on the holder are respectively engaged with each other in the radial direction of the slider. In addition, the plurality of guide projection portions which constitute one of a group of the first guide portions and a group of the second guide portions are engaged with the plurality of engaging portions provided in the protrusion wall of the button. Therefore, when the button is pushed, the slider easily moves in the sliding direction with each first guide portion of the slider sliding being guided by each second guide portion of the holder and thus it is possible to move the movable contact point to come into contact with the fixed contact point. Furthermore, it is possible to suppress rotation in the circumferential direction and wobbling of the button and the slider. In addition, since at least one guide projection portion is provided to extend in the sliding direction of the slider, it is possible to secure the strength of the guide projection portion. Furthermore, since the engagement area between the guide projection portion and the guide groove of the holder extends in the sliding direction, it is possible to suppress wobbling of the slider or the button which is inclination of the slider or the button with respect to the sliding direction. Furthermore, a fitting-in portion is provided on a side surface of the guide projection portion extending in the sliding direction and an end portion of the protrusion wall of the button is fitted into the fitting-in portion. Therefore, it is possible to secure the strength of the button by increasing the width or thickness of the protrusion wall of the button corresponding to a fitting-in amount of the end portion. Furthermore, it is possible to further suppress rotation of the button in the circumferential direction and wobbling of the button which is inclination of the button with respect to the sliding direction.

In the switch device according to the embodiment of the invention, a plurality of adjacent guide projection portions may be provided to extend in the sliding direction of the slider and fitting-in portions may be provided on side surfaces of the adjacent guide projection portions which do not face each other.

In addition, in the switch device according to the embodiment of the invention, the engaging portion provided on the button may be a recess portion that is recessed in an axial direction of the holder.

In addition, in the switch device according to the embodiment of the invention, the fitting-in portion provided on the guide projection portion may be a recess portion that does not penetrate the guide projection portion.

In addition, the switch device according to the embodiment of the invention may further include a coil antenna that transmits an electric wave and a substrate to which the coil antenna is connected and that is provided with the fixed contact point. The coil antenna and the substrate may be accommodated in the case and the slider may slide at a position that is closer to the holder side than the coil antenna and the substrate are.

Furthermore, the switch device according to the embodiment of the invention may be applied to a switch for starting or stopping a travel driving source of a vehicle.

According to the invention, it is possible to provide a switch device with which it is possible to suppress wobbling of a button and to secure the strength of the button or a slider.

DETAILED DESCRIPTION

Figure 1:
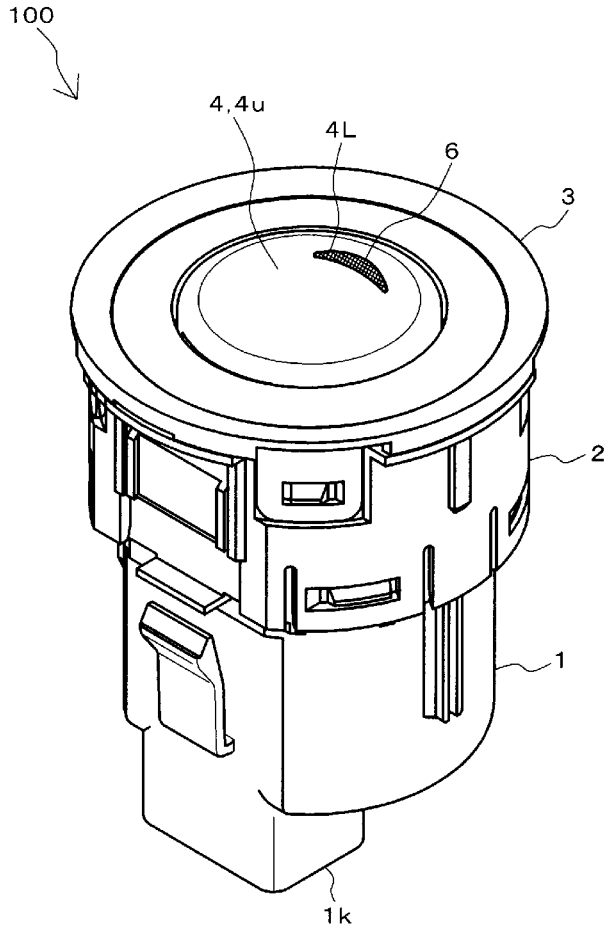
FIG. 1 is an assembled perspective view of a switch device according to an embodiment of the invention.

In an embodiment of the invention, numerous specific details are set forth in order to provide a thorough understanding of the invention. However, it will be apparent to one of ordinary skill in the art that the invention may be practiced without these specific details. In other instances, well-known features have not been described in detail to avoid obscuring the invention.

Hereinafter, an embodiment of the invention will be described with reference to drawings. In each drawing, the same portions or portions corresponding to each other are given the same reference numerals.

First, the structure of a switch device 100 in the embodiment will be described.

Figure 2:
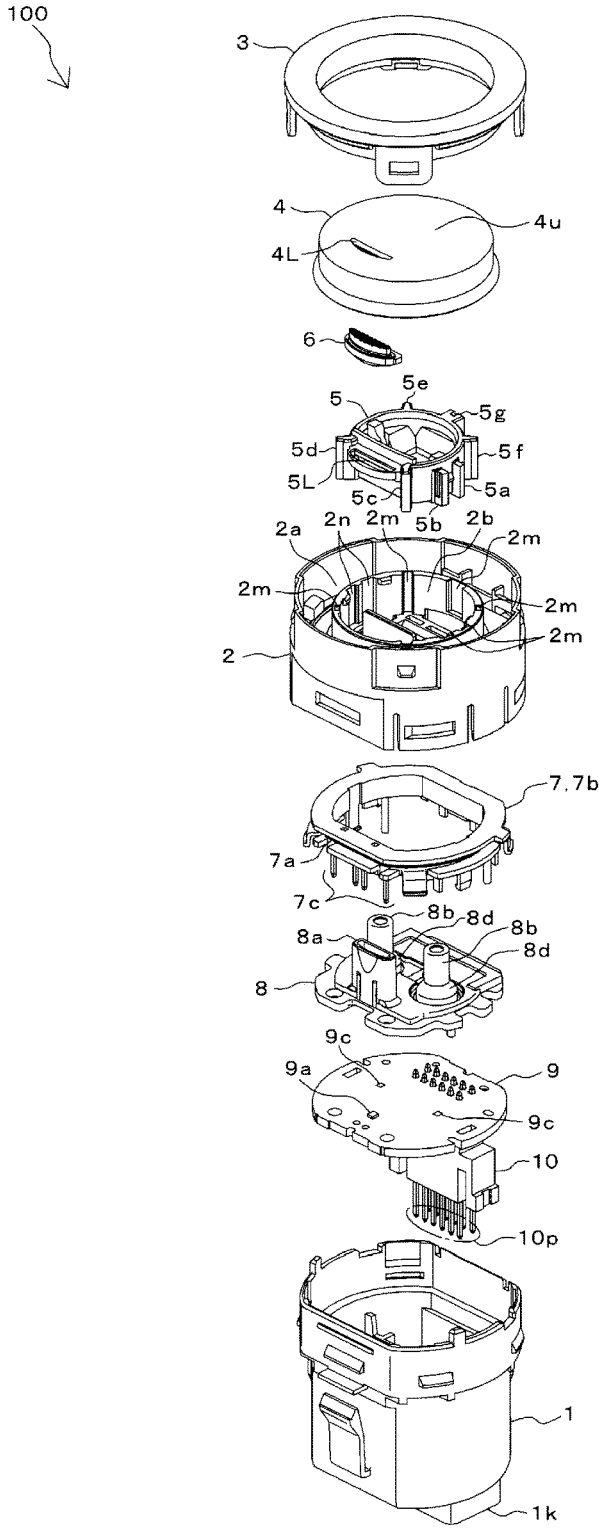
FIG. 2 is an exploded perspective view of the switch device illustrated in FIG. 1.
Figure 3:
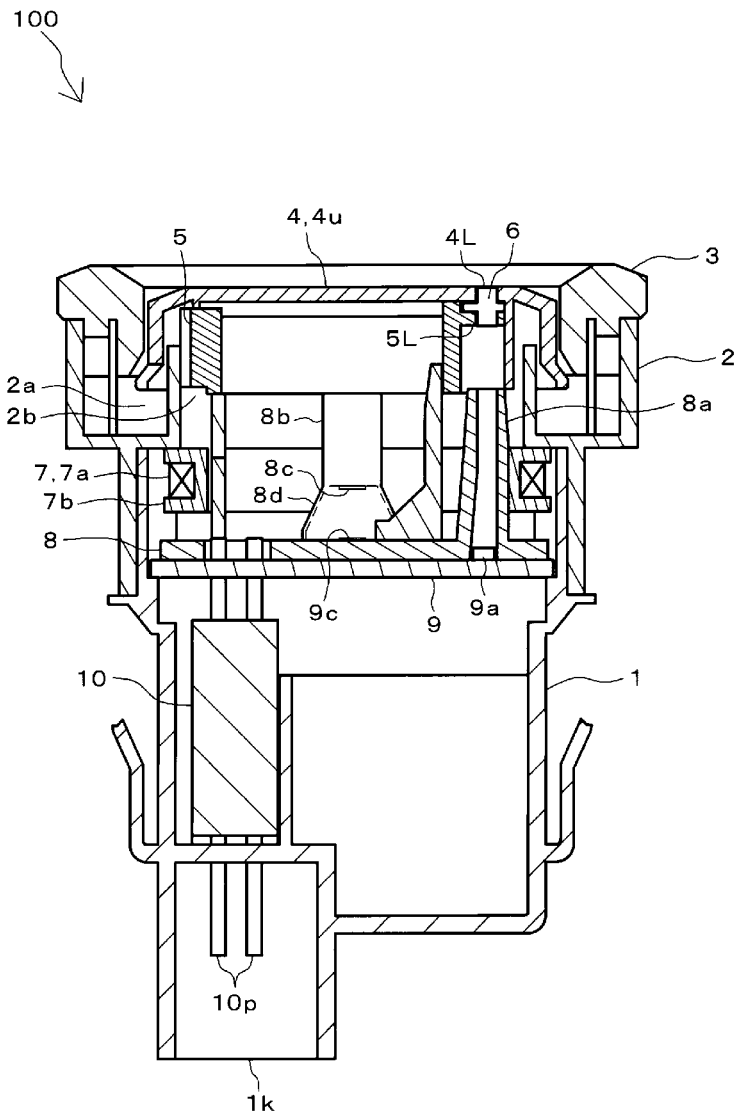
FIG. 3 is a sectional view of the switch device illustrated in FIG. 1.

FIG. 1 is an assembled perspective view of the switch device 100 according to the embodiment of the invention. FIG. 2 is an exploded perspective view of the switch device 100. FIG. 3 is a sectional view of the switch device 100.

The switch device 100 is incorporated in a vehicle security system in which a travel driving source (an engine or the like) of a vehicle is started or stopped on the basis of wireless communication between an in-vehicle device (not shown) and a portable device which is carried by a user so as to prevent the vehicle from being stolen.

The switch device 100 is installed in the vicinity of a driver's seat in the vehicle, for example. In the above-described vehicle security system, the traveling driving source is started or stopped when the portable device is successively authenticated through the wireless communication between the in-vehicle device and the portable device and a button 4 included in the switch device 100 is pushed.

As illustrated in FIG. 2, the switch device 100 includes a case 1, a holder 2, a cover 3, the button 4, a slider 5, a lens 6, a coil antenna 7, a rubber contact 8, a substrate 9, and a connector 10.

As illustrated in FIG. 3, the coil antenna 7, the rubber contact 8, the substrate 9, and the connector 10 are accommodated in the case 1. The connector 10 is soldered onto a lower surface of the substrate 9. Fitting pins 10*p* of the connector 10 protrude toward a fitting portion 1*k* formed in a lower portion of the case 1. When a socket of a harness (not shown) is fitted into the fitting portion from the lower side, the switch device 100 and the in-vehicle device are electrically connected to each other.

The substrate 9 is fixed in the case 1 with a screw or the like (not shown). As illustrated in FIG. 2, a light emitting element (an LED or the like) 9*a* and one pair of fixed contact points 9*c* (two fixed contact points 9*c*) are mounted on the upper surface of the substrate 9. As illustrated in FIG. 3, the coil antenna 7 and the rubber contact 8 are disposed close to the upper surface of the substrate 9.

As illustrated in FIG. 2, a conductive wire 7*a* is wound around a bobbin portion 7*b* of the coil antenna 7 (refer to FIG. 3 also). In addition, the bobbin portion 7*b* is provided with a lead portion 7*c* that protrudes downwards. The conductive wire 7*a* and the lead portion 7*c* are electrically connected to each other. When the lead portion 7*c* is mounted on the substrate 9, the coil antenna 7 and the substrate 9 are electrically connected to each other. When an electric current is caused to flow through the conductive wire 7*a*, an activation electric wave for operating an external portable device is transmitted from the coil antenna 7.

On the rubber contact 8, a light guiding portion 8*a* and one pair of pressing portions 8*b* (two pressing portions 8*b*) are formed to protrude upwards. As illustrated in FIG. 3, the light guiding portion 8*a* is formed to have a tube-like shape. A cup portion 8*d* is formed below each pressing portion 8*b*. A lower portion of each cup portion 8*d* is opened and a movable contact point 8*c* is provided on an inner bottom surface of each cup portion 8*d*. Although only one of the pressing portions 8*b* and only one of the cup portions 8*d* are illustrated in FIG. 3, the other of the pressing portions 8*b* and the other of the cup portions 8*d* also have the same configurations as illustrated in FIG. 3.

The rubber contact 8 is interposed between the bobbin portion 7*b* and the substrate 9 such that the light emitting element 9*a* is positioned inside the light guiding portion 8*a* and each fixed contact point 9*c* of the substrate 9 faces the movable contact point 8*c* of each pressing portion 8*b*. The light guiding portion 8*a* and each pressing portion 8*b* pass through an area inside the bobbin portion 7*b*. An upper end portion of the light guiding portion 8*a* and an upper end portion of each pressing portion 8*b* protrude upwards from the case 1. The light guiding portion 8*a* guides light emitted by the light emitting element 9*a* upwards. Each cup portion 8*d* urges each pressing portion 8*b* and each movable contact point 8*c* upwards. The rubber contact 8 is an example of an "elastic member" according to the embodiment of the invention.

Figure 4:
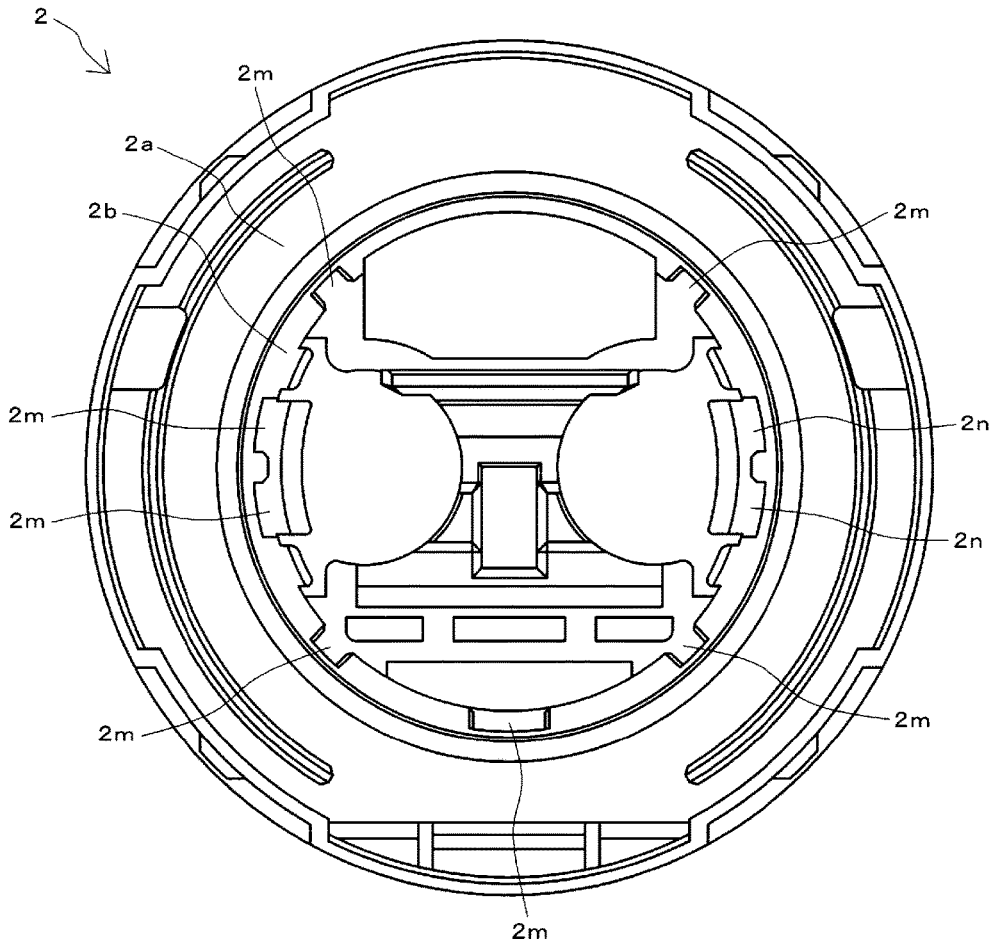
FIG. 4 is a top view of a holder illustrated in FIG. 2.
Figure 5A:
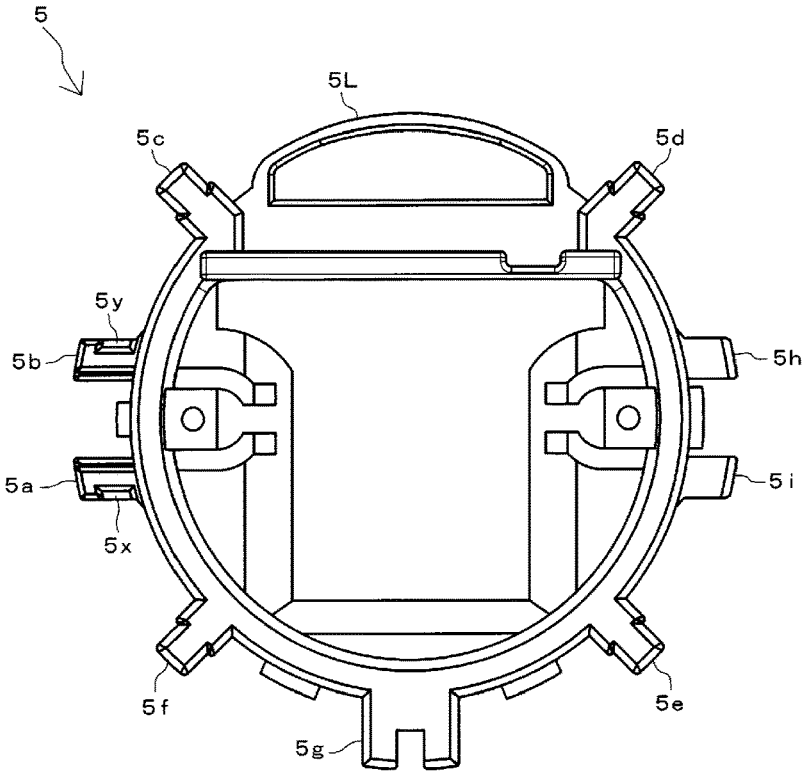
FIG. 5A is a top view of a slider illustrated in FIG. 2.
Figure 5B:
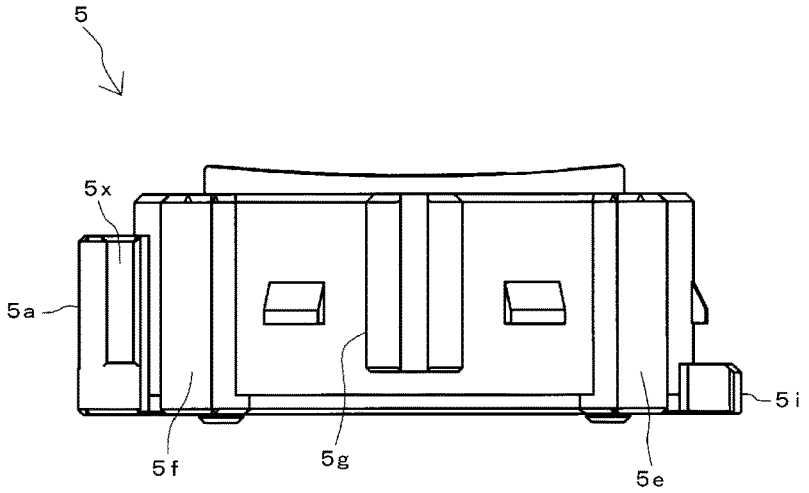
FIG. 5B is a side view of the slider illustrated in FIG. 2.
Figure 5C:
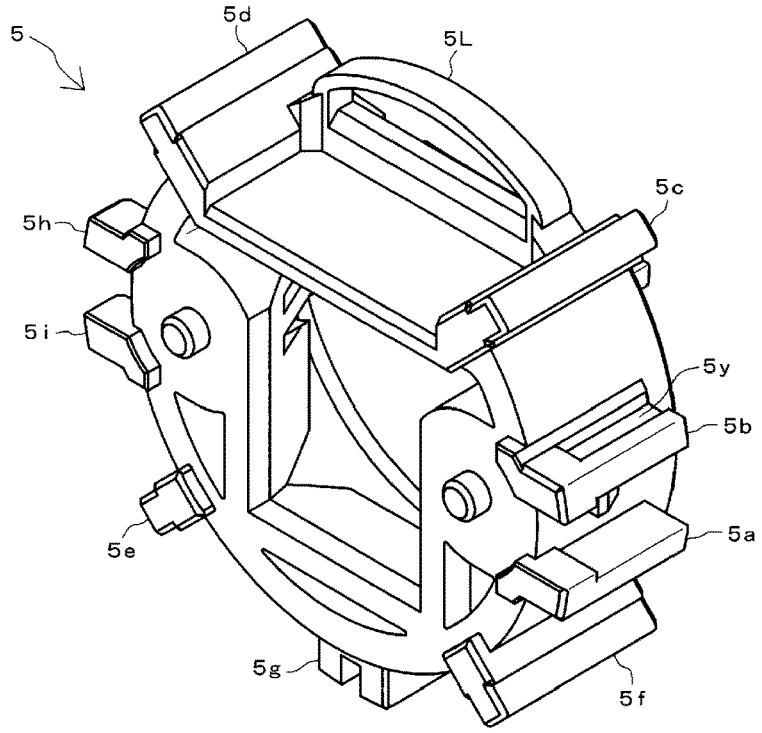
FIG. 5C is a perspective view of the slider illustrated in FIG. 2.
Figure 6:
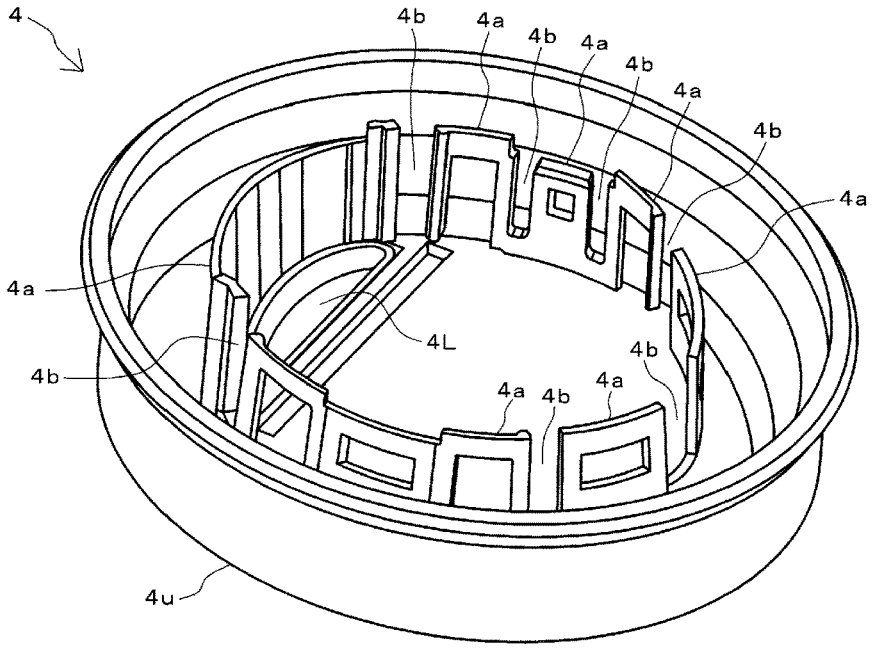
FIG. 6 is a perspective view of a button illustrated in FIG. 2 as seen from a rear side.
Figure 7:
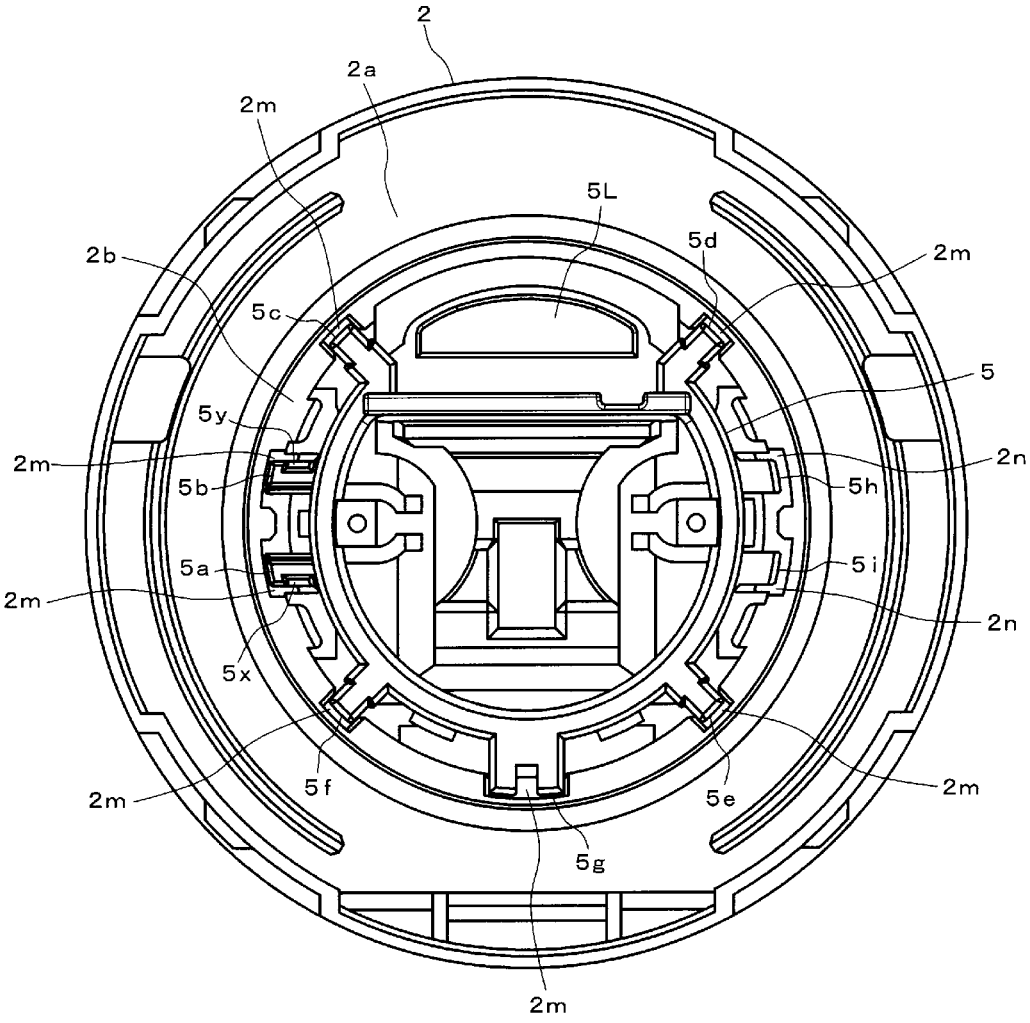
FIG. 7 is an assembled view of the holder and the slider illustrated in FIG. 2.
Figure 8:
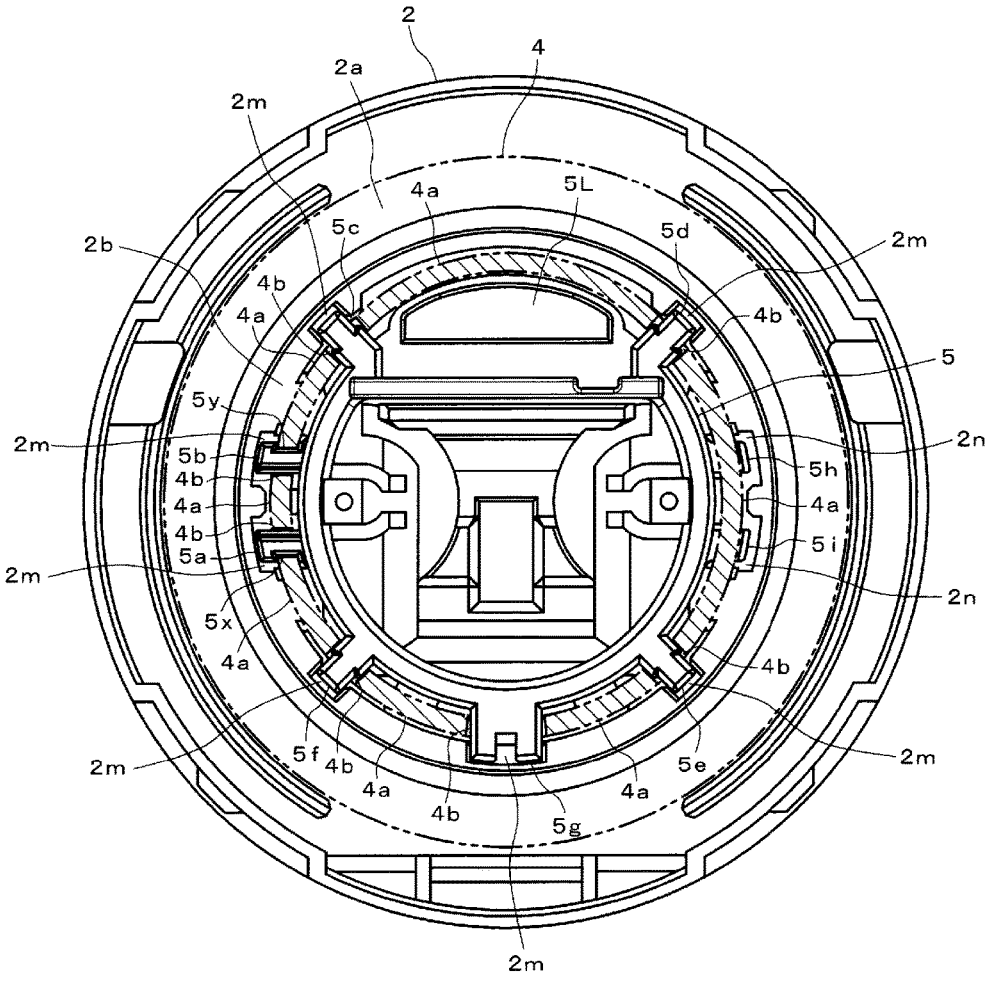
FIG. 8 is an assembled view of the holder, the slider, and the button illustrated in FIG. 2.

FIG. 4 is a top view of the holder 2. FIG. 5A is a top view of the slider 5. FIG. 5B is a side view of the slider 5. FIG. 5C is a perspective view of the slider 5. FIG. 6 is a perspective view of the button 4 as seen from the rear side. FIG. 7 is an assembled view of the holder 2 and the slider 5. FIG. 8 is an assembled view of the holder 2, the slider 5, and the button 4.

As illustrated in FIG. 2 or the like, the holder 2 is formed to have a tube-like shape. As illustrated in FIGS. 1 and 3, the holder 2 is attached to an upper portion of the case 1.

As illustrated in FIGS. 2 to 8, a first holding portion 2*a* which holds the button 4 such that the button 4 can slide upwards and downwards and a second holding portion 2*b* which holds the slider 5 such that the slider 5 can slide upwards and downwards are formed in an upper portion of the holder 2 (which is opposite to the case 1). The second holding portion 2*b* is formed to be closer to the central axis of the holder 2 than the first holding portion 2*a* is.

Therefore, as illustrated in FIG. 3, the slider 5 is disposed inside the button 4 such that an upper portion thereof is covered by the button 4. In addition, the button 4 and the slider 5 are held by the holder 2 such that the button 4 and the slider 5 are positioned on a side opposite to the case 1 side. Furthermore, the button 4 and the slider 5 slide upwards and downwards at a position closer to the holder 2 side than the coil antenna 7 and the substrate 9 are.

As illustrated in FIGS. 2, 3, and the like, a lens holding portion 5L which holds the lens 6 is formed in the slider 5. An opening portion 4L through which an upper portion of the lens 6 is exposed is formed in the button 4. As illustrated in FIG. 3, the upper end portion of the light guiding portion 8*a* of the rubber contact 8 protrudes in the holder 2 and faces a lower portion of the lens 6. Therefore, light from the light emitting element 9*a* which is guided by the light guiding portion 8*a* is incident on the lower portion of the lens 6 and is emitted to an area above the button 4.

As illustrated in FIG. 2, the cover 3 is formed to have an annular shape.

When the cover 3 is attached to an upper portion of the holder 2, the button 4 fitted into the first holding portion 2*a* of the holder 2 is restricted from moving upwards as illustrated in FIG. 3. An upper surface 4*u* of the button 4 is exposed through the cover 3 (FIG. 1). In order to start or stop the travel driving source of the vehicle, the button 4 is pushed from above.

As illustrated in FIG. 3, the slider 5 fitted into the second holding portion 2*b* of the holder 2 is restricted from moving upwards by the button 4. The upper end portion of each pressing portion 8*b* of the rubber contact 8 protrudes in the holder 2 and is engaged with a lower portion of the slider 5. Each pressing portion 8*b* urges the slider 5 upwards (to the button 4 side). The slider 5 slides in a vertical direction when the button 4 is pushed.

As illustrated in FIGS. 2, 5A, 5B, 5C, 7, and 8, a plurality of guide projection portions 5*a* to 5*i* which protrude in a radial direction are provided on an outer circumferential surface of the slider 5 at predetermined intervals in a circumferential direction. Among these, a plurality of adjacent guide projection portions 5*a* to 5*g* are provided to extend in a sliding direction (vertical direction) of the slider 5. That is, as illustrated in FIGS. 2, 5B, and 5C, the heights of the guide projection portions 5*a* to 5*g* are substantially the same as the height of the slider 5. The heights of the other guide projection portions 5*h* and 5*i* are equal to or lower than the half of the height of the slider 5. The guide projection portions 5*a* to 5*i* are an example of a "first guide portion" according to the embodiment of the invention.

As illustrated in FIGS. 5A to 5C, fitting-in portions 5*x* and 5*y* are provided on side surfaces of the guide projection portions 5*a* and 5*b* which do not face each other. Each of the fitting-in portions 5*x* and 5*y* are recess portions having predetermined depths which do not penetrate the guide projection portions 5*a* and 5*b*.

As illustrated in FIGS. 4, 7, and 8, a plurality of guide grooves 2*m* and 2*n* are provided on an inner circumferential surface of the second holding portion 2*b* of the holder 2 at predetermined intervals in the circumferential direction. Each of the guide projection portions 5*a* to 5*g* of the slider 5 is engaged with each guide groove 2*m*. Each of the guide projection portions 5*h* and 5*i* of the slider 5 is engaged with each guide groove 2*n*. The guide grooves 2*m* and 2*n* are an example of a "second guide portion" according to the embodiment of the invention.

As illustrated in FIG. 6, a protrusion wall 4*a* and engaging portions 4*b* are provided on the rear side of the button 4 along a circumferential direction of the button 4. As illustrated in FIG. 8, the protrusion wall 4*a* is interposed between an inner circumferential surface of the second holding portion 2*b* of the holder 2 and the slider 5. Each of the engaging portions 4*b* is a recess portion that is recessed in an axial direction of the holder 2 and a plurality of engaging portions 4*b* are provided in the protrusion wall 4*a* at predetermined intervals in the circumferential direction of the button 4. Each of the guide projection portions 5*a* to 5*g* of the slider 5 is engaged with each engaging portion 4*b*. Facing end portions of the protrusion wall 4*a* are fitted into the fitting-in portions 5*x* and 5*y* which are provided on the side surfaces of the guide projection portions 5*a* and 5*b*.

Next, an operation of the switch device 100 will be described.

In an usual state illustrated in FIGS. 1 and 3, the upper surface 4*u* of the button 4 is pushed downwards. As a result, in accordance with the fall of the button 4, the slider 5 slides downwards and each pressing portion 8*b* of the rubber contact 8 is pressed downwards. Accordingly, each cup portion 8*d* buckles and each movable contact point 8*c* comes into contact with each fixed contact point 9*c* on the substrate 9 so that a turn-on signal is transmitted from the switch device 100 to the in-vehicle device on the outside of the switch device 100 via the connector 10 and the harness.

Thereafter, the pushed button 4 is released. As a result, each movable contact point 8*c* is separated from each fixed contact point 9*c* due to an elastic force (restoring force) from each cup portion 8*d* of the rubber contact 8 and thus the turn-on signal is not transmitted from the switch device 100 to the in-vehicle device on the outside of the switch device 100 via the connector 10 and the harness (a turned-off state). In addition, each pressing portion 8*b* rises due to the elastic force (restoring force) from each cup portion 8*d* so that the slider 5 slides upwards (to the button 4 side). Accordingly, the slider 5 lifts the button 4 up and the button 4 returns to a regular position.

In the above-described embodiment, each of the plurality of guide projection portions 5*a* to 5*g* of the slider 5 and each of the plurality of guide grooves 2*m* of the holder 2 are engaged with each other in a radial direction of the slider 5 (FIG. 8). In addition, each of the guide projection portions 5*a* to 5*g* of the slider 5 and each of the plurality of engaging portions 4*b* provided in the protrusion wall 4*a* of the button 4 are engaged with each other. Therefore, when the button 4 is pushed, the slider 5 easily moves in the sliding direction with each of the guide projection portions 5*a* to 5*g* of the slider 5 sliding being guided by each guide groove 2*m* of the holder 2 and thus it is possible to move each movable contact point 8*c* to come into contact with each fixed contact point 9*c*. Furthermore, it is possible to suppress rotation in the circumferential direction and wobbling of the button 4 and the slider 5.

In addition, since the guide projection portions 5*a* to 5*g* of the slider 5 are provided to extend in the sliding direction of the slider 5, it is possible to secure the strengths of the guide projection portions 5*a* to 5*g*. Furthermore, since the engagement area between the guide projection portions 5*a* to 5*g* and the guide grooves 2*m* of the holder 2 extends in the sliding direction, it is possible to suppress wobbling of the slider 5 or the button 4 which is inclination of the slider 5 or the button 4 with respect to the sliding direction.

Furthermore, the fitting-in portions 5*x* and 5*y* are provided on the side surfaces of the guide projection portions 5*a* and 5*b* of the slider 5 and the end portions of the protrusion wall 4*a* of the button 4 are fitted into the fitting-in portions 5*x* and 5*y* (FIG. 8). Therefore, it is possible to secure the strength of the button 4 by increasing the width or thickness of the protrusion wall 4*a* of the button 4 corresponding to a fitting-in amount of the end portions. Furthermore, it is possible to further suppress rotation of the button 4 in the circumferential direction and wobbling of the button 4 which is inclination of the button 4 with respect to the sliding direction.

In addition, in the above-described embodiment, the plurality of adjacent guide projection portions 5*a* to 5*g* are provided to extend in the sliding direction of the slider 5. In addition, the fitting-in portions 5*x* and 5*y* are provided on the side surfaces of the adjacent guide projection portions 5*a* and 5*b* which do not face each other (FIG. 5A). Therefore, it is possible to further suppress wobbling of the slider 5 and the button 4 which is inclination of the slider 5 and the button 4 with respect to the sliding direction and rotation of the button 4 in the circumferential direction within a range corresponding to installation angles of the plurality of adjacent guide projection portions 5*a* to 5*g*. Furthermore, since the fitting-in portions 5*x* and 5*y* do not penetrate the guide projection portions 5*a* and 5*b*, it is possible to prevent a decrease in strength of the guide projection portions 5*a* and 5*b*.

In the above-described embodiment, sliding portions of the holder 2, the button 4, and the slider 5 are disposed closer to the holder 2 side than the coil antenna 7 and the contact points 8*c* and 9*c* are. Therefore, it is possible to design the dimensions or sliding lengths of the holder 2, the button 4, and the slider 5 without dimensional restriction caused by the coil antenna 7 and the contact points 8*c* and 9*c*.

Figure 9:
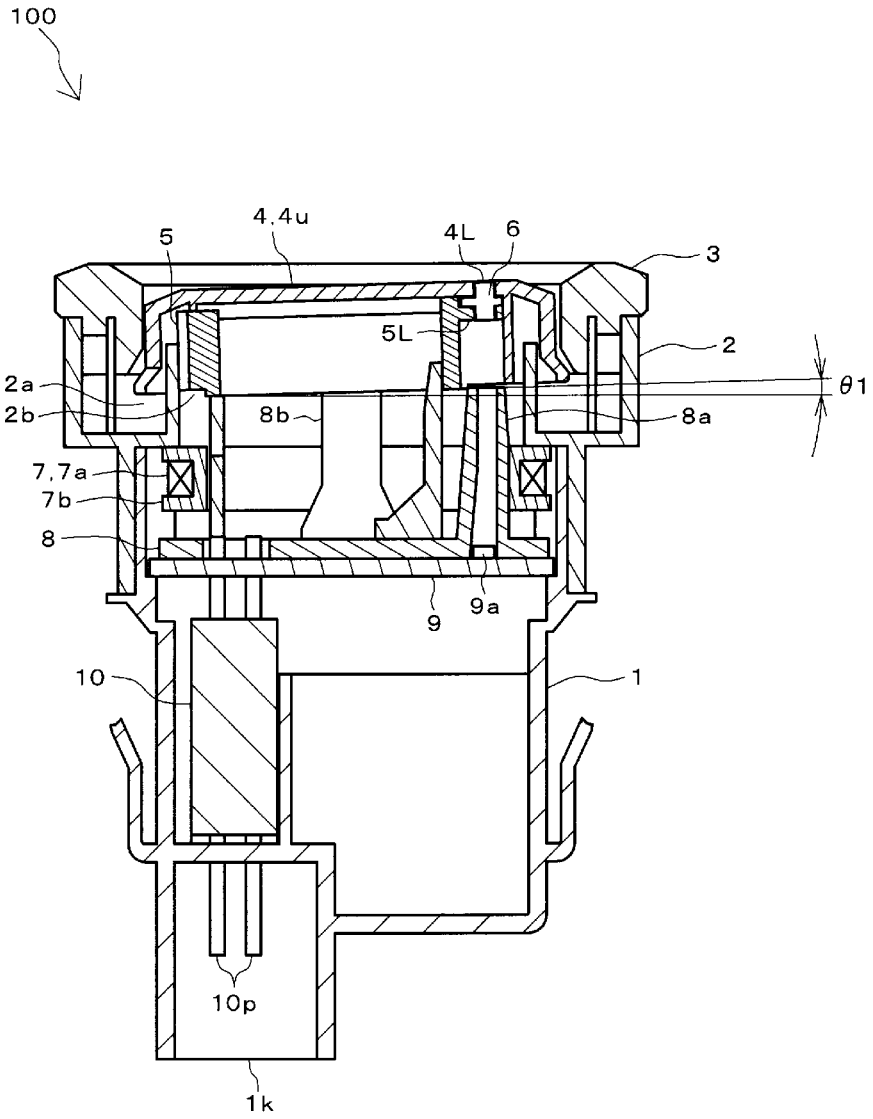
FIG. 9 is a sectional view illustrating an example of a wobbling state of the button in the switch device illustrated in FIG. 1.
Figure 10:
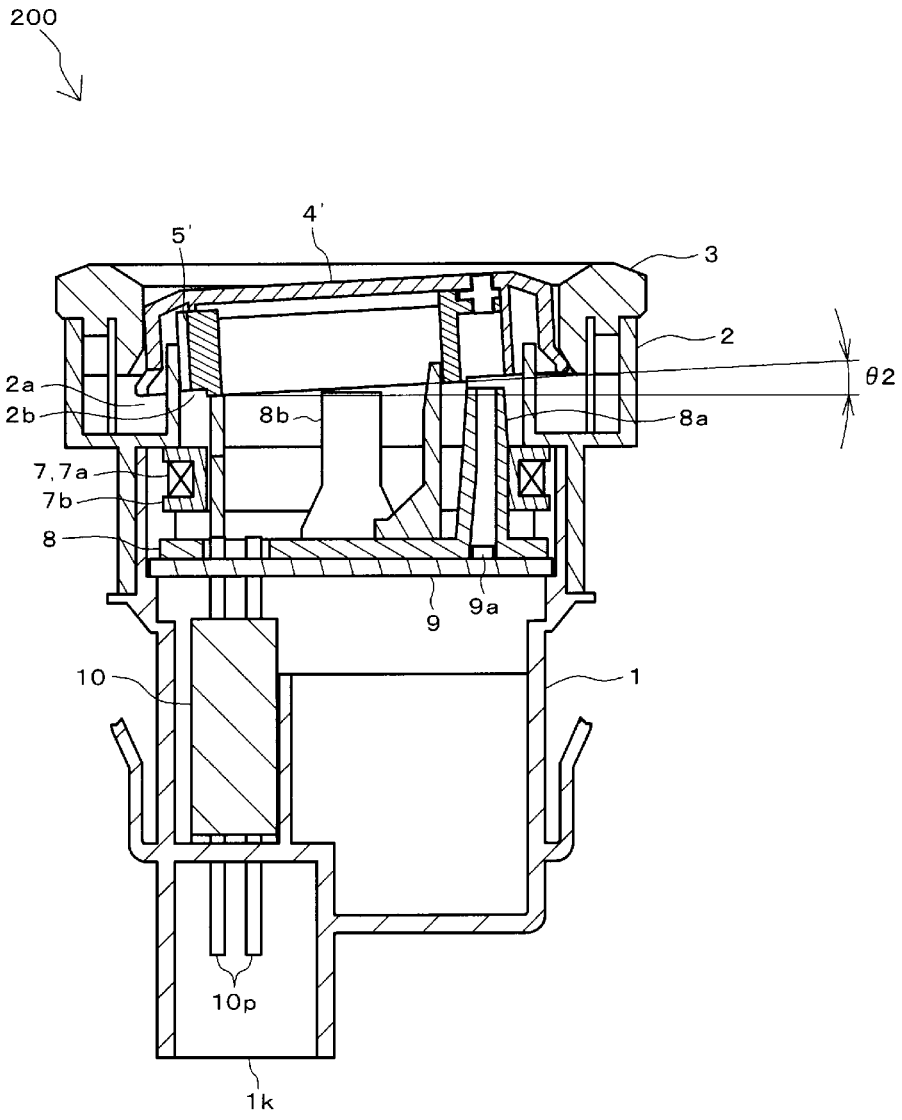
FIG. 10 is a sectional view illustrating an example of a wobbling state of a button in a switch device according to a comparative example.
Figure 11:
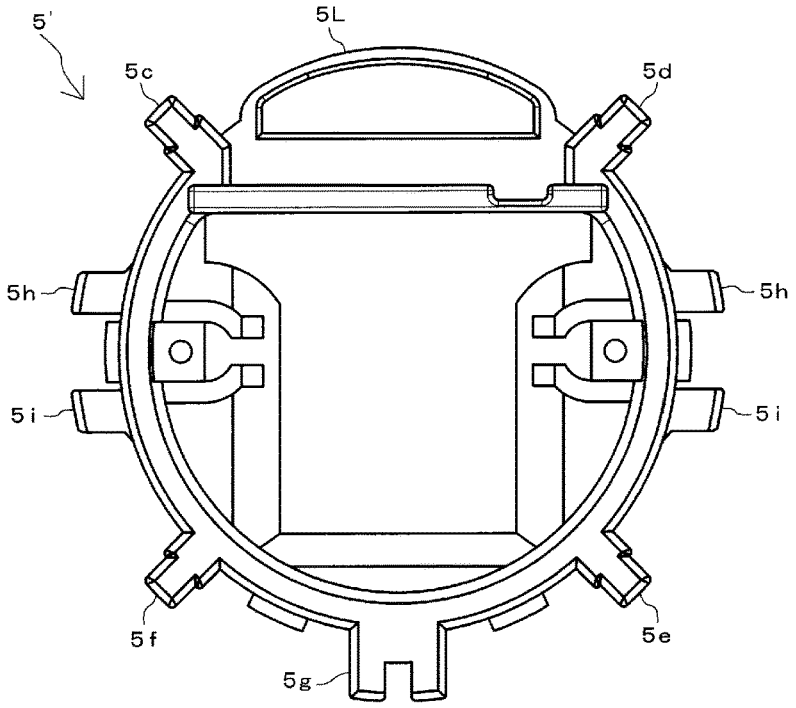
FIG. 11 is a top view of a slider in the switch device according to the comparative example.
Figure 12:
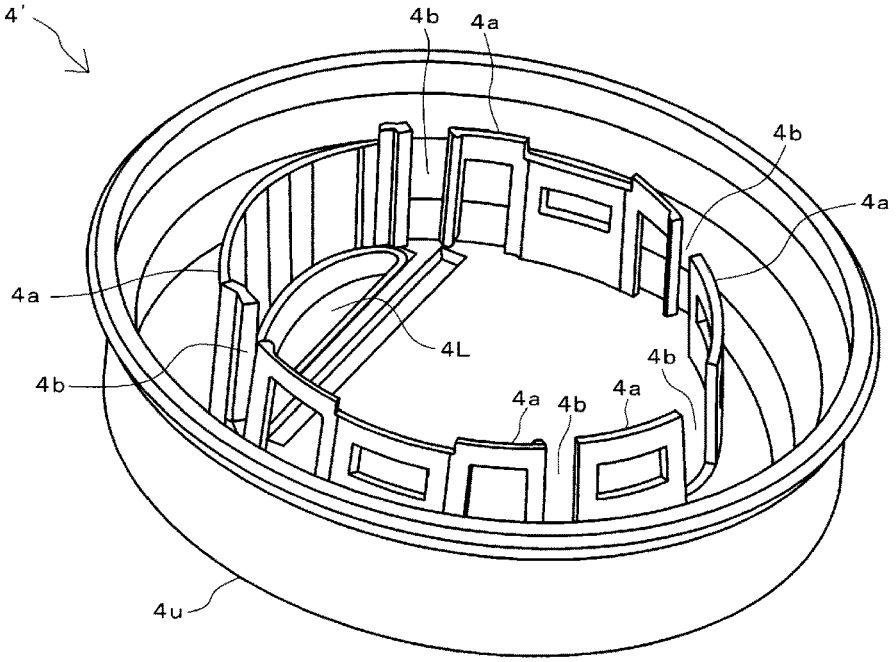
FIG. 12 is a perspective view of the button in the switch device according to the comparative example.

FIG. 9 is a sectional view illustrating an example of a wobbling state of the button 4 in the switch device 100 according to the embodiment. FIG. 10 is a sectional view illustrating an example of a wobbling state of a button 4' in a switch device 200 according to a comparative example. FIG. 11 is a top view of a slider 5' in the switch device 200 according to the comparative example. FIG. 12 is a top view of the button 4' in the switch device 200 according to the comparative example.

As illustrated in FIG. 11, in the switch device 200 of the comparative example, the slider 5' is formed to be symmetric in a transverse direction and the guide projection portions 5*h* and 5*i* having a small height are provided instead of the guide projection portions 5*a* and 5*b* having a large height (FIG. 5A). Meanwhile, as illustrated in FIG. 12, the protrusion wall 4*a* of the button 4' is provided with no engaging portion with which the guide projection portions 5*h* and 5*i* are engaged, as is evident from comparison between FIG. 12 and FIG. 6. Therefore, in a case where the dimensional tolerances for the sliding portions of the holder 2, the button 4', and the slider 5' do not match, the gaps between the sliding portions become large and wobbling of the button 4', which is inclination of the button 4' with respect to a pushing direction (the vertical direction) of the button 4', becomes great as illustrated in FIG. 10, for example. In addition, there may be a decrease in the operability with the button 4' being pushed in a state of being inclined and the inclined button 4' or the slider 5' may not move up to a predetermined position so that each movable contact point does not come into contact with each fixed contact point.

With regard to this, in the switch device 100 of the embodiment, the guide projection portions 5*a* and 5*b* and the fitting-in portions 5*x* and 5*y* of the slider 5, the engaging portions 4*b* of the button 4, and the guide grooves 2*m* of the holder 2 are engaged with each other. Therefore, as illustrated in FIG. 9, it is possible to suppress wobbling of the button 4 which is inclination of the button 4 with respect to the pushing direction. Specifically, even in a case where the dimensional tolerances for the sliding portions of the holder 2, the button 4, and the slider 5 do not match, it is possible to suppress a wobbling inclination angle θ1 of the button 4 in FIG. 9 to be equal to or lower than the half of a wobbling inclination angle θ2 of the button 4' in FIG. 10.

The invention can adopt various embodiments other than the above-described embodiment. For example, in the above-described embodiment, an example, in which a portion of the plurality of guide projection portions 5*a* to 5*i* which are provided on the outer circumferential surface of the slider 5, (that is, the guide projection portions 5*a* to 5*g*) are provided to extend in a height direction, has been described. However, the invention is not limited to this. Instead of this, for example, dimensions in the height direction of all of the plurality of guide projection portions 5*a* to 5*i*, which are provided on the outer circumferential surface of the slider, may be set to be as large as possible. In addition, two or more guide projection portions which are not adjacent to each other may be provided to extend in the height direction. In addition, it is not necessary to provide a plurality of guide projection portions protruding in the height direction and any configuration can be adopted as long as at least one of the guide projection portions 5*a* to 5*i* is provided to extend in the height direction. Furthermore, installation positions of the guide projection portion extending in the height direction and the fitting-in portion may not be adjacent to each other and may be appropriately selected.

In addition, in the above-described embodiment, an example, in which the slider 5 is provided with the guide projection portions 5*a* to 5*i* and the holder 2 is provided with the guide grooves 2*m* and 2*n*, has been described. However, on the contrary to this, the slider 5 may be provided with a guide groove and the holder 2 may be provided with a guide projection portion.

In addition, in the above-described embodiment, the engaging portions 4*b* provided in the button 4 are recess portions. However, the engaging portions may be projection portions. In this case, each of the guide projection portions 5*a* to 5*g* of the slider 5 may be provided with a recess portion which is engaged with each projection portion.

In addition, in the above-described embodiment, an example, in which the two guide projection portions 5*a* and 5*b* are respectively provided with the fitting-in portions 5*x* and 5*y*, has been described. However, only the guide projection portion 5*a* (or 5*b*) may be provided with the fitting-in portion 5*x* (or 5*y*). That is, any configuration can be adopted as long as at least one guide projection portion is provided with a fitting-in portion.

In addition, in the above-described embodiment, an example, in which the coil antenna 7 is disposed below the sliding portions of the holder 2, the button 4, and the slider 5, has been described. However, the invention is not limited to this. Instead of this, for example, the coil antenna 7 may be disposed inside the holder 2, the button 4, or the slider 5.

Furthermore, in the above-described embodiment, an example, in which the invention is applied to the switch device 100 for starting or stopping a travel driving source of a vehicle, has been described. However, the invention may also be applied to a switch device for driving another target object.

While the invention has been described with respect to a limited number of embodiments, those skilled in the art, having benefit of this disclosure, will appreciate that other embodiments can be devised which do not depart from the scope of the invention as disclosed herein. According, the scope of the invention should be limited only by the attached claims.

The invention claimed is:

1. A switch device comprising:
a button to be pushed;
a slider that slides when the button is pushed;
a tube-shaped holder in which the button and the slider are slidably held;
a case that is attached to a portion of the holder which is opposite to the button;
a fixed contact point that is accommodated in the case;
a movable contact point that is accommodated in the case and moves so as to come into contact with the fixed contact point when the slider slides; and
an elastic member that is accommodated in the case and urges the slider and the movable contact point toward the button,
wherein the slider comprises:
a plurality of first guide portions which are provided on an outer circumferential surface of the slider at predetermined intervals in a circumferential direction,
wherein the holder comprises:
a first holding portion which holds the button;
a second holding portion which is provided closer to a central axis of the holder than the first holding portion and holds the slider; and
a plurality of second guide portions which are provided on an inner circumferential surface of the second holding portion at predetermined intervals in the circumferential direction and are engaged with the plurality of first guide portions,
wherein one of the first guide portion and the second guide portion is a guide projection portion which protrudes in a radial direction of the slider, and the other of the first guide portion and the second guide portion is a guide groove which is recessed in the radial direction of the slider,
wherein the button comprises:
a protrusion wall which is interposed between the inner circumferential surface of the second holding portion and the slider; and
a plurality of engaging portions which are provided in the protrusion wall at predetermined intervals in a circumferential direction of the button and are respectively engaged with a plurality of guide projection portions, and
wherein at least one guide projection portion is provided to extend in a sliding direction of the slider, and a fitting-in portion into which an end portion of the protrusion wall is fitted is provided on a side surface of the guide projection portion extending in the sliding direction.

2. The switch device according to claim 1,
wherein a plurality of adjacent guide projection portions are provided to extend in the sliding direction of the slider and fitting-in portions are provided on side surfaces of the adjacent guide projection portions which do not face each other.

3. The switch device according to claim 1,
wherein each of the plurality of engaging portions is a recess portion that is recessed in an axial direction of the holder.

4. The switch device according to claim 1,
wherein the fitting-in portion is a recess portion that does not penetrate the guide projection portion.

5. The switch device according to claim 1, further comprising:

a coil antenna that transmits an electric wave; and a substrate to which the coil antenna is connected and that is provided with the fixed contact point, wherein the coil antenna and the substrate are accommodated in the case, and wherein the slider slides at a position that is closer to the holder side than the coil antenna and the substrate are.

6. The switch device according to claim 1, wherein the switch device is a switch for starting or stopping a travel driving source of a vehicle.

* * * * *